United States Patent [19]

Harris

[11] 4,323,017

[45] Apr. 6, 1982

[54] BURNER APPARATUS

[76] Inventor: Loren A. Harris, Rte. 1, Box 294, Montague, Calif. 96064

[21] Appl. No.: 140,712

[22] Filed: Apr. 16, 1980

[51] Int. Cl.[3] ..... F23K 3/00

[52] U.S. Cl. ..... 110/110; 110/267; 110/327

[58] Field of Search ..... 110/101 R, 104 R, 104 B, 110/105.6, 110, 267, 289, 292, 327

[56] References Cited

U.S. PATENT DOCUMENTS

| | | | |
|---|---|---|---|
| 1,922,960 | 8/1933 | Klein | 110/110 |
| 2,034,890 | 3/1936 | Wynn, Jr. | 110/110 |
| 2,056,478 | 10/1936 | Miller | 110/101 R |
| 2,067,583 | 1/1937 | Stark | 110/101 R |
| 2,122,733 | 7/1938 | Van Rijswijk | 110/110 |
| 2,141,764 | 12/1938 | Riddell . | |
| 2,143,328 | 1/1939 | Miller | 110/267 |
| 2,365,679 | 12/1944 | Casey | 110/110 |
| 2,452,453 | 10/1948 | Graham | 110/110 |

*Primary Examiner*—Henry C. Yuen

*Attorney, Agent, or Firm*—Kolisch, Hartwell & Dickinson

[57] ABSTRACT

Apparatus constructed to burn solid fuel within a firebox. The apparatus includes a burner having a receptacle and a jacket forming an air chamber about the receptacle. A fuel-feed conduit and an air-supply tube mounted adjacent the conduit for exchanging heat therewith are adapted to extend into the firebox. The burner is detachably mounted on the conduit and tube, in cantilever fashion within the firebox, through a port communicating with the air chamber and a duct communicating with the lower interior portion of the receptacle, respectively. Forced air supplied to the air chamber through the tube is vented into the upper region of the receptacle to support combustion of fuel supplied to the receptacle through the conduit and duct. The jacket's upper side wall inclines outwardly on progressing downwardly from the receptacle's upper opening to divert spill-over ash and clinker material away from the receptacle.

1 Claim, 6 Drawing Figures

BURNER APPARATUS

BACKGROUND AND SUMMARY OF THE INVENTION

The present invention relates to burner apparatus, and more particularly, to apparatus having a burner which is easily connected to fuel and air-supply conduits.

Heating devices such as furnaces and dryers which utilize solid fuel are well known. A typical solid-fuel heating device includes a burner located within a firebox and conduits through which solid fuel and combustion-supporting air are supplied to the burner. With extended operation, combustion heat tends to warp or otherwise degrade the burner, requiring expensive and time-consuming burner replacement. Heat transfer from the burner to the device's fuel-supply conduit may produce fuel obstruction in the conduit, for a reason now to be considered.

One type of solid fuel which has recently been developed is pelletized biowaste, such as densified wood-waste pellets having a 10% to 12% moisture content. Characteristically, the pelletized fuel swells during dehydration. Consequently, when the fuel is used in heating devices of the type described above, where significant heat transfer from the burner to the fuel-supply conduit occurs, the fuel may become significantly dehydrated and expanded within the conduit, producing fuel conduit obstruction. This problem has limited the use of fuel of this type in prior art solid-fuel heating devices, despite efficient combustion and relatively low cost of pelletized biowaste fuel.

It is one general object of the present invention to provide, for use in a furnace or dryer firebox, solid-fuel burner apparatus which substantially overcomes the just-discussed problems associated with the prior art.

A more specific object is to provide such apparatus having a burner which is easily removed for cleaning and replacement.

Another object of the invention is to provide such apparatus constructed to reduce heat transfer to the fuel-feed components thereof.

Still another object of the invention is to provide apparatus in which ash and clinkers are diverted away from the apparatus.

Yet another object of the invention is to provide such apparatus having a burner which is mounted in cantilever fashion within a firebox by detachable connection to fuel-infeed and air-supply conduits extending into the firebox.

The apparatus of the present invention includes a fuel-feed conduit and an air-supply tube mounted adjacent the conduit, in heat-exchange relationship therewith. The conduit and tube are adapted to extend into the firebox of a heating device. The burner in the apparatus includes a receptacle having an upper opening and a jacket forming an air chamber about the receptacle. The burner is detachably mounted on the conduit and tube through a port communicating with the air chamber and a duct communicating with the receptacle's interior, respectively. Forced air supplied to the air chamber through the tube is vented into the upper region of the receptacle. The jacket has an upper side wall portion which inclines outwardly on progressing downwardly from the receptacle's upper opening, to divert spill-over ash and clinker material away from the receptacle.

These and other objects and features of the present invention will become more fully apparent from the following detailed description of preferred embodiments of the invention, in conjunction with the accompanying drawings, wherein.

DETAILED DESCRIPTION OF PREFERRED EMBODIMENTS OF THE INVENTION

Figure 1:
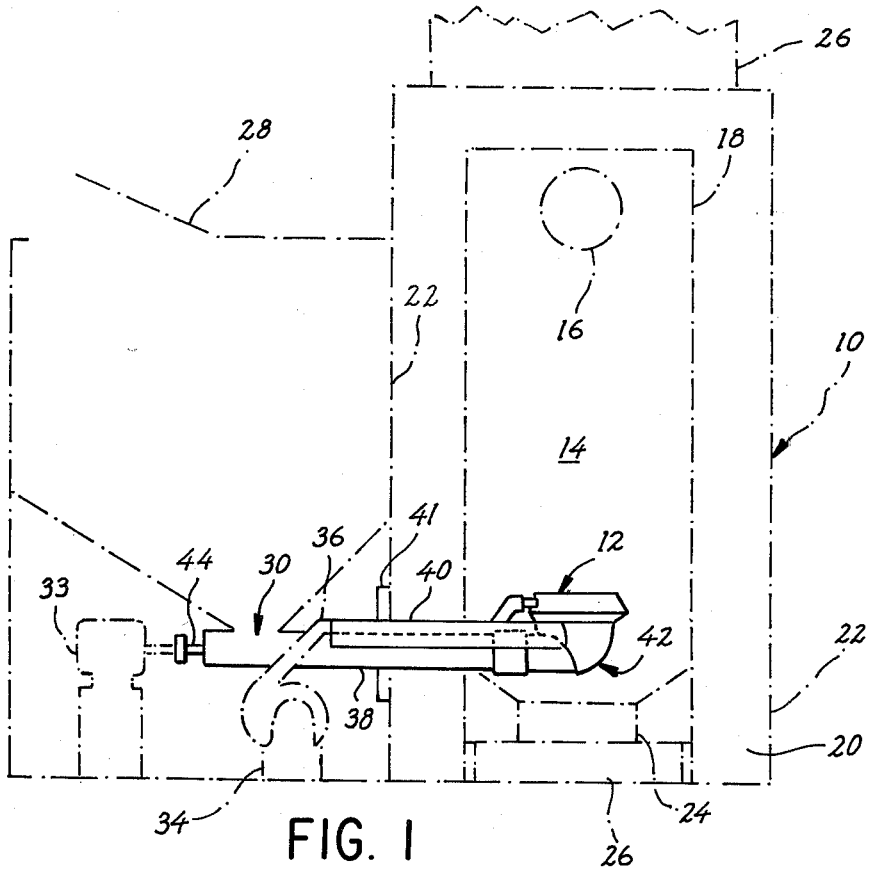
FIG. 1 is a side view of apparatus constructed according to one embodiment of the present invention, shown installed in a heating device illustrated somewhat schematically.

Looking first at FIG. 1, there is shown a furnace 10 typifying a heating device equipped with a burner apparatus 12 constructed according to one embodiment of the present invention. The apparatus is generally indicated by solid lines, and remainder parts of the furnace, by dash-dot lines. The furnace includes an upright cylindrical firebox 14 which is vented, adjacent its upper end in FIG. 1, by a duct 16 in the firebox wall 18. Air is circulated, either passively or actively, by conventional means, through an annular air jacket 20 formed between wall 18 and the furnace's outer wall 22. Tapered wall structure 24 located in the lower region of firebox 14 serves to divert ashes and clinkers from apparatus 12 downwardly and inwardly into an ash-collection box 26.

Furnace 10 is designed to utilize solid fuel such as pelletized wood waste. The fuel is stored in a hopper 28 located adjacent the furnace, as shown. Fuel from hopper 28 is supplied to apparatus through an opening 30, under the control of motor 33. Forced air is supplied to the apparatus by a blower 34.

Furnace 10 may be equipped with a thermostatic device which functions to switch motor 33 and blower 34 coordinately between "off" and constant-speed "on" conditions, with total heat output in apparatus 12 being determined by the relative durations of the two conditions. Alternatively, the thermostatic device may exert variable-speed control over motor 33 and blower 34, to control the instantaneous rate of heat production in the apparatus. The two just-mentioned modes of heat control are entirely conventional, and do not form part of the present invention.

Apparatus 12 generally includes a fuel-supply conduit 38 and an air-supply tube, or conduit 40 which is mounted on the upper side of conduit 38, in heat exchange relationship therewith. Conduit 38 and tube 40 extend through jacket 20 into the firebox as shown, and are mounted on the furnace by a collar 41 secured to the furnace wall. A burner, indicated generally at 42, is detachably connected to conduit 38 and tube 40, in a manner to be described, and is supported thereon within the firebox in cantilever fashion.

Figure 2:
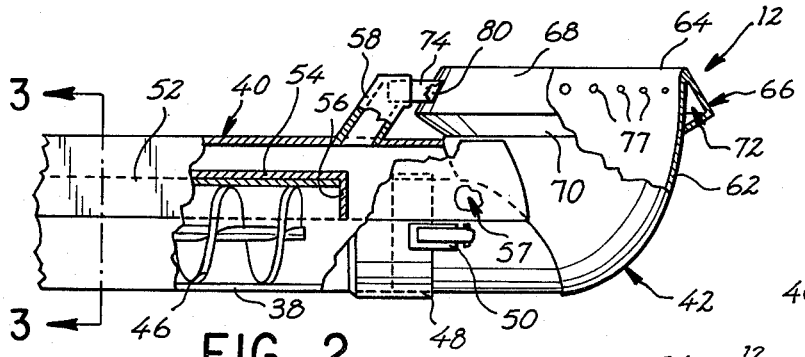
FIG. 2, is an enlarged, framentary, and partially cutaway side view of the apparatus shown in FIG. 1.

Mounted within conduit 38 is an auger screw 46, seen fragmentarily in FIG. 2. Screw 46 is somewhat close-fitting in relation to the interior of conduit 38, and rotatable therein about the conduit's central axis. As seen in FIG. 2, screw 46 terminates short of the right end of the conduit. Powered rotation of screw 46, by motor 33, serves to transport solid fuel supplied to the conduit through opening 30 in a left-to-right direction in FIG. 1.

Looking at FIG. 2, the right end region of conduit 38 extends axially about half way into a cylindrical sleeve 48, and is secured therein, as by welding. A pair of snap locks, such as lock 50, are mounted on sleeve 48, at diametrically opposed positions thereon, for a purpose to be described.

Figure 3:
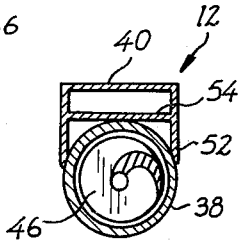
FIG. 3, is a sectional view taken along line 3—3 in FIG. 2.

With reference particularly to FIGS. 2 and 3, tube 40 is formed of a section 52 of inverted U-shaped sheet metal which covers an upper portion of conduit 38 and is attached thereto, as by welding. An elongate partitioning plate 54 is joined along its edges to opposed vertically disposed sides of section 52, as seen in FIG. 3, to form the bottom of tube 40. By this construction tube 40 is in intimate heat-exchange relationship with conduit 38. The two air spaces defined between the upper surface of conduit 38 and plate 54 are closed, adjacent the right end of plate 54 in FIG. 2, by a pair of substantially triangular-shaped caps, such as cap 56.

Figure 4:
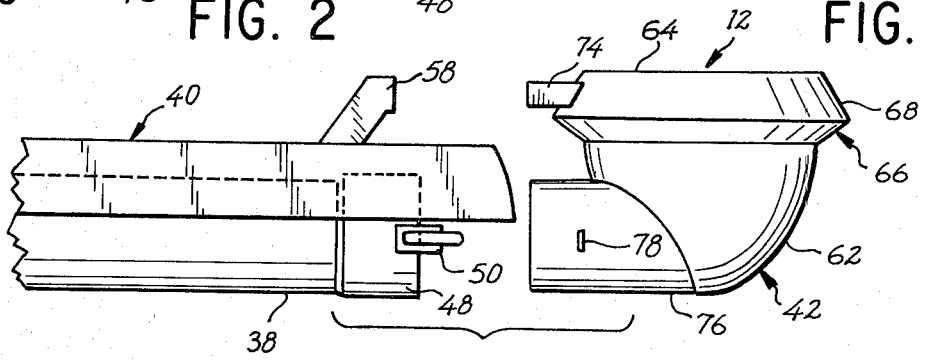
FIG. 4, is a view similar to FIG. 2, but showing the apparatus of FIG. 1 in disassembled form.

As seen in FIGS. 2 and 4, the right end region of section 52 extends beyond the right end of sleeve 48 and is fashioned to fit the contours of burner 42, when the burner is connected to conduit 38 and tube 40, as shown in FIG. 2. There is thus formed between the right end region of section 52 and burner 42 an air space 57 which is supplied forced air from blower 34.

Tube 40 is connected to apparatus 42 through an angled, tubular neck 58 which communicates, at its lower end in FIG. 2, with the interior of tube 40, and at its upper, right end, with burner 42 as will be described.

With reference to FIGS. 2 and 4, burner 42 includes a receptacle, or bowl, 62 having an upper opening 64. As seen in FIG. 2, the sheet metal material forming bowl 62 is folded downwardly, at the bowl's upper opening, to form an annular collar, or shell 66 having the generally V-shaped cross section seen in FIG. 2. The upper annular side wall portion, or face 68 of the collar inclines radially outwardly away from bowl 62 on progressing downwardly from the bowl's upper opening. The collar's lower face 70 is joined at its lower edge to the side of the bowl to form therewith an annular chamber 72 about the upper portion of the bowl. Collar 66 is also referred to herebelow as means defining chamber 72.

A tube connector, or collar 74 is attached to face 68 to communicate with chamber 72, through a port 80 in face 68, forming a first entrance-defining means on the left side of the burner in FIG. 4. Connector 74 is dimensioned to be received snugly within the laterally extending portion of neck 58. Forced air supplied to chamber 72 through port 80 is vented through aperture means including a plurality of angularly spaced apertures, such as apertures 77, formed in the bowl and communicating with chamber 72.

A duct, or collar 76 attached to bowl 62 directly below connector 74 communicates with the lower interior portion of the bowl forming a second entrance-defining means on the left side of the burner in FIG. 4. Duct 76 is dimensioned and positioned to be received somewhat snugly within the right portion of sleeve 48 in FIG. 2, when connector 74 is received in neck 58. A pair of staples, such as staple 78 (FIG. 4), are secured to diametrically opposed sides of duct 76 to engage associated locks, such as lock 50, to releasably secure duct 76 to sleeve 48, to secure the burner to the conduit.

Operation of apparatus 12 will now be described. As noted above, motor 33 is operable to rotate screw 46 in a direction effecting movement of solid fuel from hopper 28 in a left-to-right direction in FIG. 1, thus moving the fuel through conduit 38 and duct 76 into the interior of bowl 62. Here the fuel is pushed toward the upper portion of the bowl, as fresh fuel enters the bowl through duct 76. Fuel in the upper portion of bowl 62 is ignited by a conventional pilot-light device (not shown). Once the fuel is ignited, fuel combustion is supported by forced air from blower 34 which is introduced through tube 40 into the upper portion of the bowl through apertures, such as apertures 77.

Figure 5:
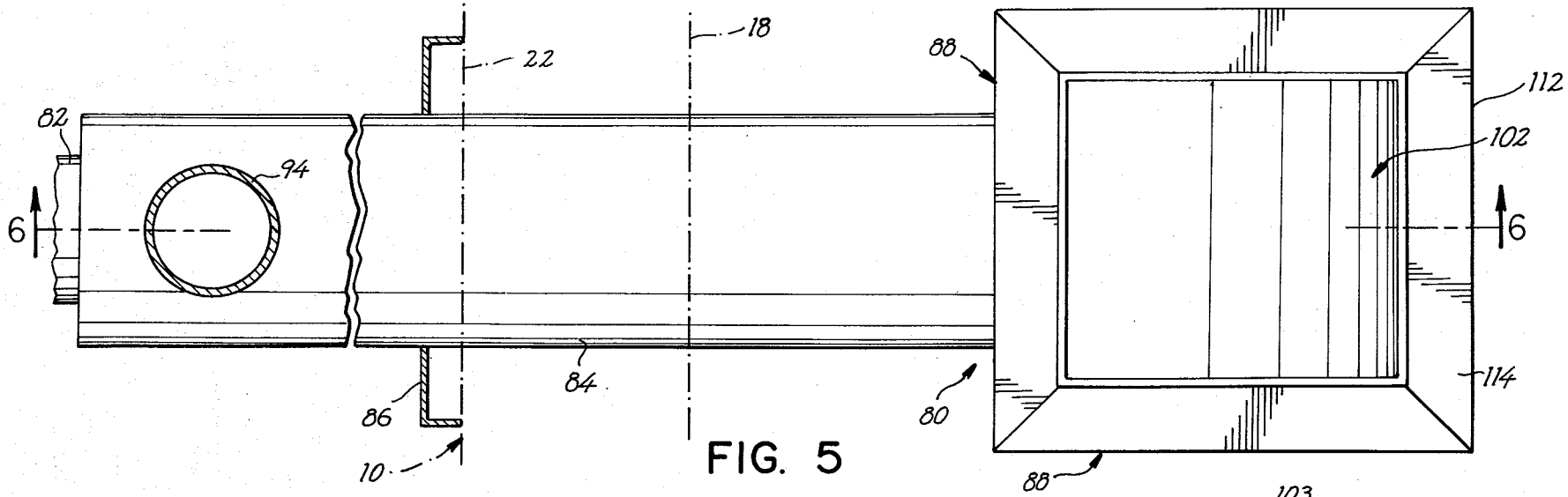
FIG. 5 is a top, relatively enlarged view of apparatus constructed according to a second embodiment of the present invention.
Figure 6:
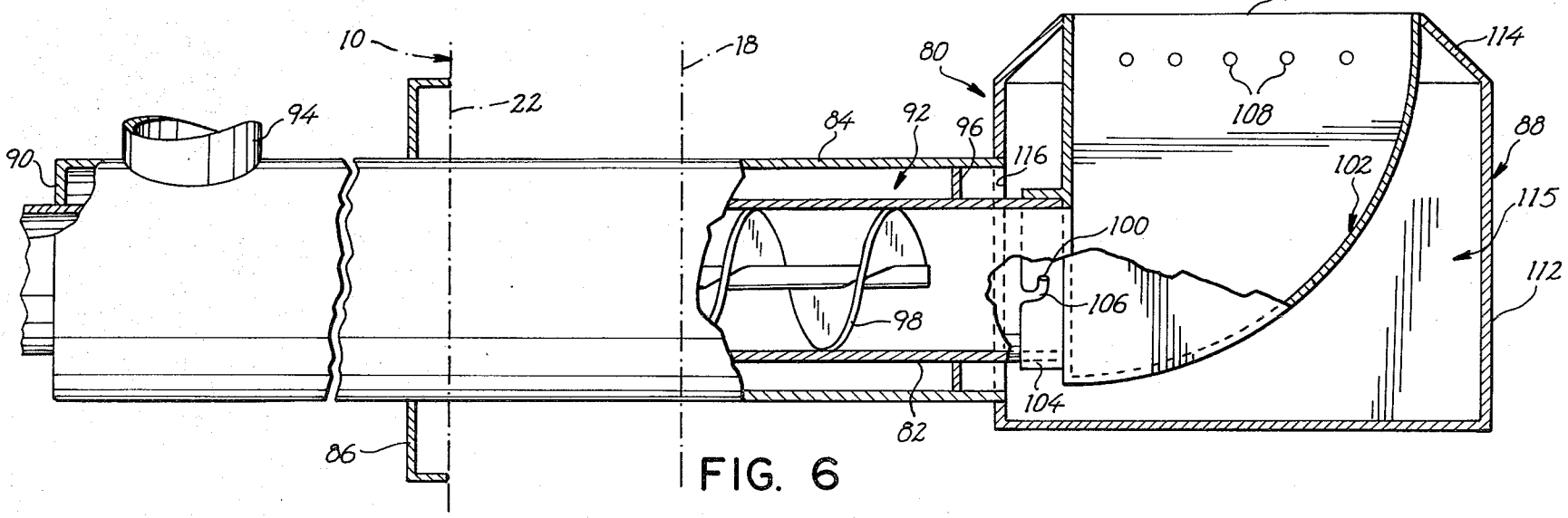
FIG. 6 is a side view of the apparatus of FIG. 5 shown partially in section along line 6—6 in FIG. 5.

In FIGS. 5 and 6, there is shown at 80 apparatus constructed according to a second embodiment of the present invention. Apparatus 80 generally includes a fuel-supply conduit 82 and an air-supply tube, or conduit 84 which is disposed coaxially about a portion on the conduit. Tube 84 and conduit 82 extend through the walls of a furnace, such as walls 18, 22 in furnace 10, described with reference to FIG. 1. A collar 86 is used in securing tube 84 to wall 22, as shown. A burner, indicated generally at 88, is detachably connected to conduit 82 and tube 84 in a manner to be described, and is supported therein within the furnace's firebox in cantilever fashion.

Tube 84 is cylindrical metal tubing which is open at its right end, where the tube communicates with burner 88. The left end portion of the tube in FIG. 5 is bent inwardly to form an annular lip 90 (FIG. 6) which is sealed to the outer wall of conduit 82. Forced air is introduced into the annular space between conduit 82 and tube 84 by a forced-air blower, such as blower 34 in FIG. 1, which communicates with the just-mentioned space through a pipe 94.

Conduit 82, which is also cylindrical metal tubing, is held coaxially within tube 84 at the tube's left end by lip 90, as noted above, and adjacent the tube's right end in FIG. 6 by webs, such as web 96 connecting the tube and conduit. Conduit 82 is supplied solid fuel from a hopper, such as the one shown in FIG. 1. The fuel is transported in a left-to-right direction in FIGS. 5 and 6 by an auger screw 98 rotatably mounted within the conduit and driven by a motor, such as motor 33, in FIG. 1. The right end portion of conduit 82 extends beyond the right end of tube 84, and has attached thereto a pair of diametrically opposed pins, such as pin 100, in FIG. 6, for a purpose to be described.

Burner 88 includes a receptacle 102 having an upper opening 103. The receptacle takes the form of a cylindrical quadrant, as can be appreciated in FIGS. 5 and 6. A duct, or collar 104 formed on the lower region of the receptacle's left side wall in FIG. 6, communicates with the interior of the receptacle, and is dimensioned to receive the right end portion of conduit 82 snugly therein. A pair of diametrically opposed keyways, such as keyway 106, formed in duct 104 coact with pins, such as pin 100 on conduit 82, to lock the duct on the conduit with slight rotation of the burner relative to the conduit, as can be appreciated from FIG. 6.

Completing the description of receptacle 102, a plurality apertures, such as apertures 108, are formed in the walls adjacent the receptacle's upper end region. These apertures, whose purpose will become clear below, are also referred to herebelow as aperture means.

Receptacle 102 is encased in a box-like jacket 112 which has a four-sided upper wall portion 114, the upper edges of which are joined to associated edges in the receptacle's upper opening. An air chamber 115 formed between the receptacle and the jacket receives air from tube 84, through a port 116 formed in the left side of the jacket. Port 116 is dimensioned to receive the right end of tube 84 snugly therein when conduit 82 is connected to duct 104. Forced air supplied to chamber 115 is vented through apertures, such as apertures 108. Jacket 112 is also referred to herebelow as means defining chamber 115.

Operation of apparatus 80 is similar to that described above with reference to apparatus 12. Briefly, fuel in conduit 82 is transported through duct 104 into the lower region of the receptacle, as screw 98 in the conduit is rotated. The fuel is pushed toward the upper portion of the receptacle where it is ignited. Fuel combustion is supported by forced air introduced through tube 84 into chamber 115, and from chamber 115 into the upper portion of the receptacle through apertures, such as apertures 108.

The present invention is constructed to limit heat buildup in a solid-fuel burner. In apparatus 12, forced air circulating through collar 66 surrounding the upper portion of the burner limits such heat buildup. Collar 66 thereby serves both as a conduit through which air is supplied to the burner at the upper region thereof, and as a heat jacket through which air used in cooling this portion of the burner circulates. In apparatus 80 heat in receptacle 102 is carried away, in part, by air circulating through chamber 115, and vented through apertures, such as apertures 108. In apparatus 80, of course, the entire receptacle is cooled by the circulating air.

The present invention is constructed to be fueled by pelletized fuel which is susceptible to dehydration and swelling upon heating. To this end, the fuel-supply conduits in both apparatus described are maintained in a relatively cool condition. This is accomplished first, by cooling the conduit by heat transfer to forced air being supplied to the associated burner, and secondly, by limiting heat transfer from the burner in each apparatus to the associated fuel-supply conduit.

In each of the apparatus described, ash and clinker material produced in the receptacle's upper region spills over the upper opening thereof, as this material is displaced by fresh fuel supplied to the burner. Such spillover prevents buildup of clinker material in the receptacle, which otherwise would tend to choke off combustion in the chamber. With reference particularly to FIG. 2 and 6, it can be appreciated that spillover material is diverted away from the sides of each apparatus.

From the foregoing, it can be appreciated how objects of the present invention are met. In each apparatus, the burner can be easily attached to and detached from, in "plug-in" fashion, fuel and air-supply conduits mounted on the furnace and extending into the furnace's firebox. Such allows for easy installation, replacement, and interchangeability of burners of various sizes. Each apparatus includes an air jacket through which forced air being supplied to an upper portion of the burner is circulated, to prevent heat buildup in the burner. The heat jacket is also constructed to divert spillover ashes and clinkers from the burner walls. Further, each apparatus is constructed to limit heat buildup in its fuel-supply conduit, thus preventing the fuel-supply obstruction problem noted when the apparatus is fueled by heat-swellable fuel pellets.

While two specific embodiments of the present invention have been described herein, it is obvious that various changes and modifications can be made without departing from the spirit of the invention.

It is claimed and desired to secure by letters patent:

1. Burner apparatus comprising:

an elongate fuel conduit having a metallic and thus heat conductive wall defining a passage for the supply of fuel, an elongate air conduit extending in the direction of the fuel conduit, defining a passage for the supply of air, the metallic and heat conductive wall of the fuel conduit separating the fuel and air passages whereby they are in heat exchange relationship, the air conduit having an open end and the fuel conduit having an open end and said ends facing the same direction and being adjacent each other, a burner unit including, as an integral assembly, a receptacle with an interior for holding fuel and an open top, a shell secured to and surrounding the receptacle defining an air chamber extending about the receptacle, and aperture means in said receptacle for venting air from said chamber into the receptacle, first entrance-defining means on one side of the burner unit, defining an entrance which passes through said shell and communicates with said air chamber, and second entrance-defining means on the same side of the burner unit, defining an entrance which passes through said receptacle and communicates with the interior of the receptacle, the two entrances facing a common direction to one side of said burner unit, a telescopic fit of said open end of the air conduit with said first entrance-defining means and a telescopic fit of said open end of the fuel conduit with said second entrance-defining means, releaseable means detachably locking the end of at least one conduit to the entrance-defining means with which it is telescopically fitted preventing relative axial displacement, and said air conduit extends along a side of said fuel conduit, said first entrance-defining means includes a collar joined to and projecting outwardly from said shell, said second entrance-defining means includes a collar joined to and projecting outwardly from said receptacle, and the releasable means detachably locks the end of said fuel conduit to the collar which is joined to the receptacle.

* * * * *